United States Patent [19]

Arsene et al.

[11] Patent Number: 4,858,555

[45] Date of Patent: Aug. 22, 1989

[54] FINGER MOISTENER FOR HANDLING MONEY

[76] Inventors: Dennis J. Arsene, 5711 Highfield Drive, Burnaby, B.C., Canada, V5B 1E4; Darren J. Lee, 7310 Monteclair Street, Burnaby, B.C., Canada, V5A 3J1

[21] Appl. No.: 225,794

[22] Filed: Jul. 29, 1988

[51] Int. Cl.[4] ..... B05C 1/00

[52] U.S. Cl. ..... 118/270

[58] Field of Search ..... 118/200, 209, 218, 244, 118/258, 260, 270, 264

[56] References Cited

U.S. PATENT DOCUMENTS

| | | | |
|---|---|---|---|
| 650,102 | 5/1900 | Tilly | 118/264 |
| 650,204 | 5/1900 | Tilden | 118/264 |
| 1,240,279 | 9/1918 | Wilson | 118/258 |
| 1,312,486 | 8/1919 | Krueger | 118/258 |
| 2,658,474 | 11/1953 | Sengbusch | 118/270 |

*Primary Examiner*—Willard Hoag

[57] ABSTRACT

A moistening device that includes a container having a liquid holding compartment and one or more liquid dispensing apertures in a top wall thereof. A valve in the form of a plate, movably mounted on said top wall selectively covers and uncovers the apertures; an annular wall, extends upwardly beyond the wall and a body of absorbent material is surrounded by the annular wall and retained thereby on the container. The top wall of the container and the plate valve are preferably flat plates overlying one another with the valve plate being rotatably mounted on container top wall. If desired one or more protrusion project downwardly from the valve plate corresponding in location to the apertures in the top wall of the container, so as to project thereinto in a closed position thereby closing the container in one position of the plate like member and in the other position bearing against the top wall of the container so as to lift the plate out of contact with the top wall at least on the central portion of the container top wall.

7 Claims, 2 Drawing Sheets

FINGER MOISTENER FOR HANDLING MONEY

FIELD OF INVENTION

This invention relates to a finger moistener intended primarily for those handling money, but obviously will have other applications.

BACKGROUND OF INVENTION

Moistening devices are known that include a container for holding a fluid and an absorbent body of material mounted on such body and which can be touched on an object or touched by the fingers to effect the desired moistening. A cover or a cap may also be present to avoid evaporation of the moistening material. One such device is disclosed in Canadian patent No. 106,264 issued July 9, 1907 and as disclosed therein the absorbent material extends above the container as well as downwardly into the container contacting the fluid therein. A separate, removable cap is provided and is indicated as being as air-tight closure of the bowl to prevent evaporation of the fluid. A forgetful user can leave the cap off, in which case the wicking material continues to absorb and evaporate the contents very quickly.

An object of the present invention is to provide a moistening device that holds a supply of moistening fluid and is releasable therefrom by a valved closure into an absorbent material mounted on the top of the container.

SUMMARY OF INVENTION

In keeping with the foregoing object, there is provided in accordance with the present invention, a moistening device comprising a container for holding fluid and having a top wall with at least one aperture therethrough, a plate movably mounted on the top wall selectively to cover and uncover the aperture on the top wall of the container, an open top extension on the container extending above the top wall and an absorbent pad of material located within said extension and projecting thereabove and retained therein by said extension.

BRIEF DESCRIPTION OF THE DRAWINGS

The invention as illustrated by way of example, with reference to the accompanying drawings wherein.

DESCRIPTION OF PREFERRED EMBODIMENT

Figure 1:
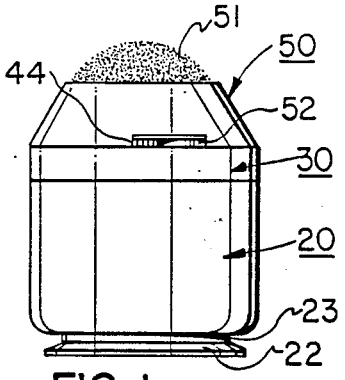
FIG. 1 is a side elevational view of a moistening device provided in accordance with the present invention.
Figure 2:
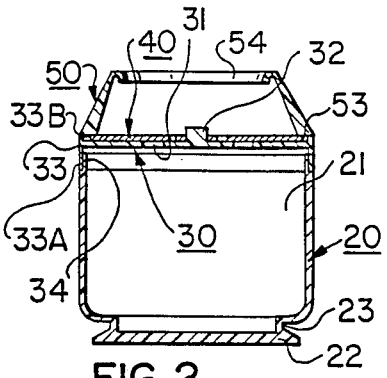
FIG. 2 is a vertical, cross-sectional view of the device illustrated in FIG. 1.

Illustrated in the drawings is a finger moistening device comprising an open top container 20 having a liquid holding compartment 21, a cover 30 mounted on the container and having at least one aperture 31 therethrough, a plate 40 rotatably mounted on the cover and having at least one aperture 41 therein alignable with the aperture 31 in the cover and a truncated conical upper extension 50 for holding a sponge or other absorbent material 51.

Figure 7:
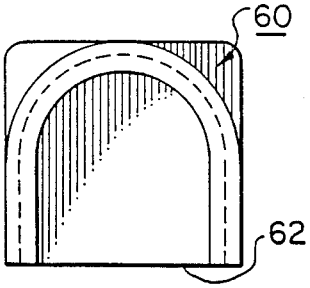
FIG. 7 is a top plan view of a base for detachably holding the moistening device of FIG. 1.
Figure 8:
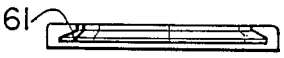
FIG. 8 is a front elevational view of FIG. 7.
Figure 9:
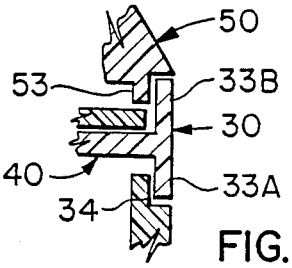
FIG. 9 is an enlarged view of the encircled portion of FIG. 2.

The container 20 is illustrated as being cylindrical, but may be of any shape and has a base 22 extending laterally beyond a necked down portion 23. The base 22 detachably anchors the moisturizing device to a grooved mounting bracket 60 that may be glued or otherwise anchored at a suitable work station, As seen in FIGS. 7 and 8, the anchoring device 60 has a groove 61, open at one edge as indicated at 62 to slidably receive the base 22 which is correspondingly shaped and mates with the groove 61.

Figure 3:
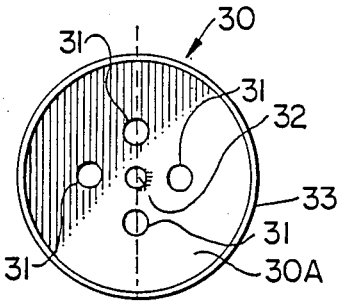
FIG. 3 is a top plan view of a cover for the top of the container portion of the device illustrated in FIG. 1.
Figure 4:
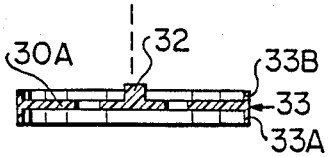
FIG. 4 is a side elevational view of FIG. 3.

The cover 30 is illustrated as being a flat disk 30A with a central, upwardly protruding stub shaft 32 and an outer peripheral ring 33 having a portion 33A projecting below the plate and a portion 33B projecting above the plate. The outer diameter of the ring 33 corresponds to the outer diameter of the container, the upper portion of the container being notched as at 34 to receive the ring. The upper part of the container effectively has a necked down portion receiving the ring and the two can be joined by frictional fit, by welding, by gluing and/or by screw fit. The plate 30A, as will be seen from FIG. 3 and 4, has four through apertures 31, equally spaced from one another and from the central stub shaft 32.

Figure 5:
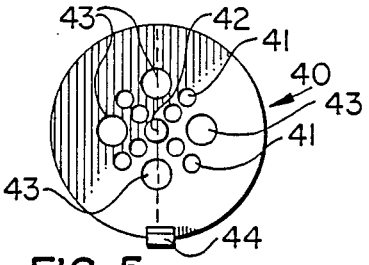
FIG. 5 is a top plan view of an aperture plate, rotatably mounted on the cover of the container.
Figure 6:
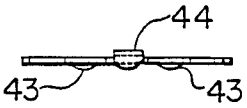
FIG. 6 is a side elevational view of FIG. 5.

The member 40, more clearly illustrated in FIGS. 5 and 6 is a flat disk having a central aperture 42 that receives the shaft 32 of the cover plate 40, and thereby being rotatably mounted on the cover plate. The two plates while shown as flat disks can be concave or convex, corresponding in shape to one another. The member 40 is provided with a series of apertures 41 arranged, as illustrated in FIG. 5, in groups of two between two adjacent circular depressed areas 43. The depressed areas 43 project downwardly toward the cover disk 30A and are correspondingly positioned with the apertures 31, so that in one position of plate 40, such protruding or projecting portions nest into and seal the respective apertures 31. The plate when moved from such position by rotation about stub shaft 32 places the downwardly protruding portions 43 against the flat upper surface of the cover plate 30A, thus raising the central portion of the member 40 slightly off the upper surface of the cover plate 30A. This allows the fluid in the container to distribute readily and be dispensed through the various apertures into the sponge when the container is either shook vigorously or temporarily inverted.

The plate 40 is provided with a radially, outwardly directed tab 44 that projects through a slot 52 in the outer wall of the conical end portion 50. The tab 44 provides a finger grip for oscillating the plate 40 about the stub shaft 32 and movement from one to the other of an open and closed position where fluid is permitted to escape from the container into the sponge and sealed in the container for non-escape therefrom.

The extension portion 50 is a truncated conical part having a bottom annular rib flange 53 that frictionally fits and nests matingly into the flange, upwardly projecting part 33B. The upper end of the conical part terminates in a reverse bend portion providing a downwardly directed lip 54 that facilitates insertion of the sponge into the cavity provided by the conical extension and serves to retain the sponge in such cavity.

The container, cover, base and upper extension can be made of a plasics material, glass, metal and/or various combinations thereof. In place of mounting base 60, base 22 on the container can be in the form of, or have attached thereto, a suction cup for anchoring the device on a desk or counter top.

Figure 10:
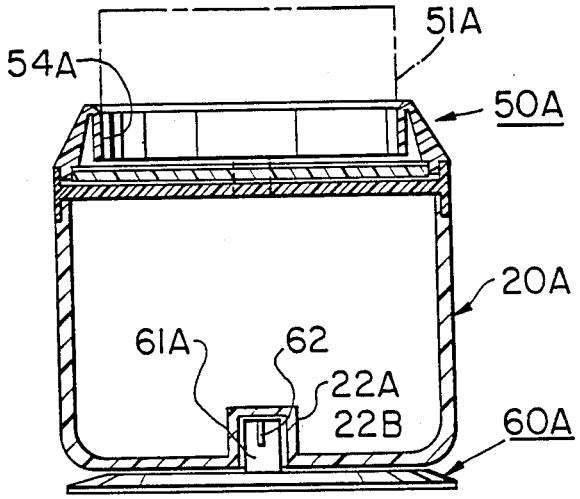
FIG. 10 is a vertical cross-sectional view similar to FIG. 2, but illustrating some modifications.

A modified mounting for the moistening device as illustrated in FIG. 10 and consists of a base 60A having an upwardly projecting central pin 61A projecting into a recess 22A in the bottom wall 22B of the container. The pin can be split as at 62A to facilitate forcing the pin into the recess which has, if desired, an entry hole slightly smaller than the free outer end of the pin. Other retaining means, if desired, can be employed for retaining the container 20A on the base for example pin 61A can have a slightly enlarged rounded outer end, snap fitting into a partial circular cavity in the bottom wall of the container.

In the embodiment illustrated in FIG. 10, the conical upper end portion 50A has an extended downwardly directed lip 54A that receives and frictionally holds a cylindrical plug type sponge or foam plastics material wetting member 51A.

We claim:

1. A moistening device comprising:

a. a container having a liquid holding compartment and at least one aperture in a top wall thereof;

b. a plate like member, movably mounted on said top wall selectively to cover and uncover said aperture(s);

c. an annular wall, extending upwardly beyond said top wall; and d. a body of absorbent material surrounded by said annular wall and retained thereby on said container.

2. A moistening device as defined in claim 1 wherein said top wall and plate like member are flat plates overlying one another and wherein said plate like member is rotatably mounted on said top wall.

3. A moistening device as defined in claim 2 wherein said plate like member has a protrusion thereon corresponding to the aperture(s) in the top wall of the container, so as to project thereinto in a closed position thereby closing the container in one position of the plate like member and in the other position bearing against the top wall of the container so as to lift the plate like member out of contact with the top wall at least on the central portion of the plate like member.

4. A moistening device as defined in claim 1 wherein said annular, upwardly extending, wall is a truncated conical member mounted on the upper end of the container.

5. A moistening device as defined in claim 1 wherein said container is an open top container, wherein said top wall is a flat plate having a plurality of apertures surrounded by a peripheral wall projecting above and below the plate, and wherein said plate like member is rotatably mounted on said plate of the cover.

6. A moistening device as defined in claim 1 wherein the top wall of the container is removably mounted on the container.

7. A moistening device as defined in claim 6 wherein said top wall is a disc-like apertured plate surrounded by an outer periheral flange projecting at least one of above and below said disc-like plate.

* * * * *